US009463641B1

(12) United States Patent
Haefner et al.

(10) Patent No.: US 9,463,641 B1
(45) Date of Patent: Oct. 11, 2016

(54) DYNAMIC CONTROL OF THERMAL EXPANSION INDUCED IMAGING ERRORS FROM LIGHT EMITTING DIODE (LED) PRINT BARS

(71) Applicant: Xerox Corporation, Norwalk, CT (US)

(72) Inventors: Mark P. Haefner, Rochester, NY (US); Paul A. Hosier, Rochester, NY (US); Roger L. Triplett, Penfield, NY (US); Terri A. Clingerman, North Rose, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/671,400

(22) Filed: Mar. 27, 2015

(51) Int. Cl.
*B41J 2/47* (2006.01)
*B41J 2/45* (2006.01)
*B41J 29/393* (2006.01)

(52) U.S. Cl.
CPC .... *B41J 2/47* (2013.01); *B41J 2/45* (2013.01)

(58) Field of Classification Search
CPC ..... B41J 2/45; B41J 2/47; B41J 2/435; B41J 29/393
See application file for complete search history.

(56) References Cited

U.S. PATENT DOCUMENTS 5,016,027 A * 5/1991 Uebbing ..... B41J 2/45 347/236
6,028,472 A * 2/2000 Nagumo ..... B41J 2/45 257/E23.08
2006/0192843 A1* 8/2006 Ohba ..... B41J 2/451 347/238

* cited by examiner

*Primary Examiner* — Geoffrey Mruk
*Assistant Examiner* — Scott A Richmond
(74) *Attorney, Agent, or Firm* — Simpson & Simpson, PLLC

(57) ABSTRACT

A method for dynamically compensating for thermal expansion and contraction of a light emitting diode print bar having first and second light emitting diodes having first and second ideal positions, respectively, the method including: a) determining a first measured position of the first light emitting diode and a second measured position of the second light emitting diode; b) comparing the first measured position and the second measured position to the first ideal position and the second ideal position, respectively; and, c) correcting a first difference between the first measured position and the first ideal position and a second difference between the second measured position and the second ideal position based on results from the step of comparing.

21 Claims, 3 Drawing Sheets

DYNAMIC CONTROL OF THERMAL EXPANSION INDUCED IMAGING ERRORS FROM LIGHT EMITTING DIODE (LED) PRINT BARS

TECHNICAL FIELD

The presently disclosed embodiments are directed to providing a method of minimizing effects of thermal expansion in a printing device, in particular, providing a method of real time dynamic correction of image errors caused by thermal expansion of a light emitting diode print bar.

BACKGROUND

As the yield and efficiency of light emitting diode (LED) technology has improved, LED print bar (LPB) imagers have been developed and used for xerographic printing applications, in higher performance and higher quality applications. For yield reasons, optical performance and compactness, full width LPBs, i.e., LPBs spanning the entire cross process direction, are often made as multi-chip assemblies carefully assembled and focused in a housing with a SELFOC® lens array, i.e., a gradient index lens array or GRIN lens array, as shown in FIG. 1. For clarity, the housing has been omitted in FIG. 1. SELFOC® lens array 50 is arranged between multi-chip LED array assembly 52 and photoreceptor drum 54. It should be appreciated that although a photoreceptor drum is depicted in FIG. 1, other photosensitive surfaces may also be used in the foregoing arrangement, e.g., a photoreceptor belt. During xerographic printing, LED light 56 from array assembly 52 is focused on drum 54 via lens array 50. The "self-focusing" property of SELFOC® lenses is well known in the art and therefore not further described herein.

As shown in FIG. 2, SELFOC® lens 50 may be formed from a plurality of gradient index lens 58 within housing 60. Housing 60 may include angled wall 62 which causes lenses 58 to align in two rows, wherein the second row is offset from the first row. In an embodiment, the longitudinal axis of each lens 58 in the second row is the aligned with the point of contact between two adjacent lenses 58 in the first row.

Due to the construction methods and characteristics of LEDs, LED chips and lenses, a LPB has imperfect imaging characteristics which can negatively impact print quality. For example, chips 64, each comprising multiple LEDs 66, are placed on a substrate, e.g., printed circuit board 68, as accurately as possible, but due to some variability in placement there are non-idealities in chip gaps and linear placement of chips 64 on the multi-chip substrate, as depicted in FIGS. 3 and 4.

Adjacent chips may be offset in the X or Y direction relative to each other. For convenience, X and Y directions are set forth on FIGS. 3 and 4. Moreover, adjacent chips may be angularly rotated relative to each other. As the foregoing non-idealities may be additive across the length of printed circuit board 68, they can contribute to bow (bi-directional arrow 70), skew (bi-directional arrow 72) and magnification error, i.e., the sum of between chip offsets in the X direction. It should be appreciated in view of FIGS. 3 and 4 that "P" is used to represent the spacing between individual LEDs 66 within a single chip 64, "PG" is used to represent the spacing between adjacent LEDs 66 within adjacent chips 64, "DY" is used to represent the difference is the Y direction, i.e., process direction, between the average position of LEDs 66 within a first chip 64 relative to the average position of LEDs 66 within a second chip 64 adjacent to the first chip 64, and "DX" is used to represent the difference between "PG" and "P". Thus, the absolute magnification error is equal to the sum of "DX" for all chip gaps, i.e., Absolute magnification error=$\Sigma_i$ $DX_i$, where i=the total number of chips, the bow/skew error is equal to the sum of "DY" for all chip gaps, i.e., Bow/skew error=$\Sigma_i$ $DY_i$, where i=the total number of chips, and bow may also be defined as P−P×DY, i.e., the error after skew is removed.

To address the potential imaging uniformity problems caused by the foregoing non-idealities, most LPB suppliers strive to minimize chip gaps and total multi-chip bow to an acceptable level for the desired print quality. The achievable placement of LED chips is usually adequate for a single LPB or monochrome print engine. However, this may not be the case for high quality monochrome printers or color printers where color to color registration is critical. Some suppliers may output chip gap or bow information in some format to enable some level of correction. While this technique may allow bow correction, it does not allow skew correction necessary for color registration. In addition, if a LPB is used as an nth color in a printer with a scanning laser imager, the corrected bow of the LPB may not match the non-zero bow of the laser imager. Moreover, the foregoing uniformity problems may be amplified or altered during use of the LPB as thermal changes to the LPB cause further chip and/or LED displacement due to the expansion or contraction of materials.

For example, gaps between chips in the cross process direction change as the temperature of the LPB changes. The material used to form printed circuit board 68 typically has a greater coefficient of thermal expansion than the material used to form chips 64. Thus, changes in temperature cause greater changes in the distance between chips 64 than the distances between LEDs 66. It is believed that due to the construction of the LPB, the locations of the largest expansion error will depend on how the LPB is mechanically mounted. For example, if the LPB is secured or pinned at one end, the largest error will be located at the opposite end, and if the LPB is secured or pinned at its middle, the expansion moves from the center outward which creates the largest error at both ends of the LPB. Moreover, chips 64 are typically secured to circuit board 68 via an epoxy deposited on the rear surface of each chip 64 at approximately its center. The epoxy is non-rigid to permit some expansion and contraction of the epoxy as the chip and/or circuit board expands or contracts. In view of the foregoing, it should be appreciated that the spaces between chips 64, i.e., chip gaps, open or close with thermal changes to the circuit board and chips. All of the foregoing changes may occur uniformly or non-uniformly depending on whether the change of temperature of the chips and circuit board occurs uniformly or non-uniformly.

Apparatus and methods to deal with this potential imaging uniformity problem under constant temperature conditions have been proposed; however, additional imaging error can be induced by thermal expansion of the print bar if the ambient temperature fluctuates during printing, or if the total print duty cycle fluctuates and causes the temperature delta between the LPB and ambient to vary. The main way this problem has been dealt with in LPB imaging systems is the technological progress in getting a reduction of LED power needed for a given exposure due to improved LED efficiency, heat sinks, active cooling, or some combination of the foregoing. Other means have been considered to remove or minimize the effects of thermal expansion. For example, reduction of gap sizes, reduction of the expansion areas, etc.

have been employed. However, none of these means have be sufficient to satisfy performance requirements.

The apparatus and method disclosed herein address these problems without incurring the cost of additional heat sinking and cooling.

SUMMARY

Broadly, the methods discussed infra provide for dynamically compensating for thermal expansion and contraction of a light emitting diode print bar having first and second light emitting diodes having first and second ideal positions, respectively. The method includes: a) determining a first measured position of the first light emitting diode and a second measured position of the second light emitting diode; b) comparing the first measured position and the second measured position to the first ideal position and the second ideal position, respectively; and, c) correcting a first difference between the first measured position and the first ideal position and a second difference between the second measured position and the second ideal position based on results from the step of comparing.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1:
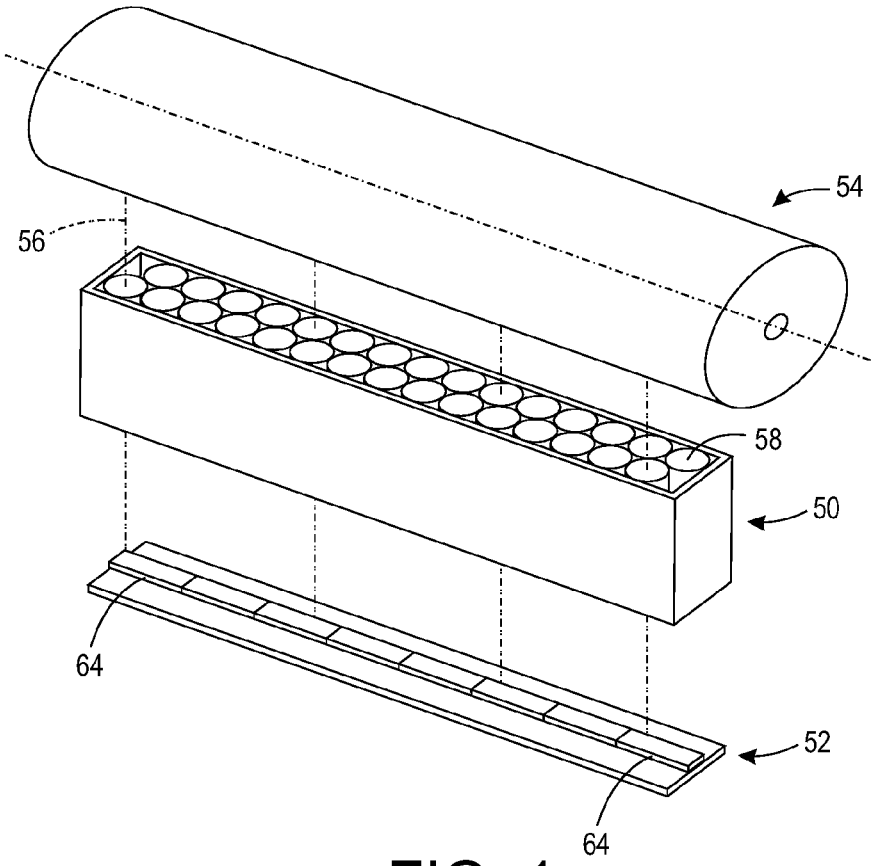
FIG. 1 is a perspective view of a portion of a known light emitting diode, gradient index lens array and photoreceptor arrangement.
Figure 2:
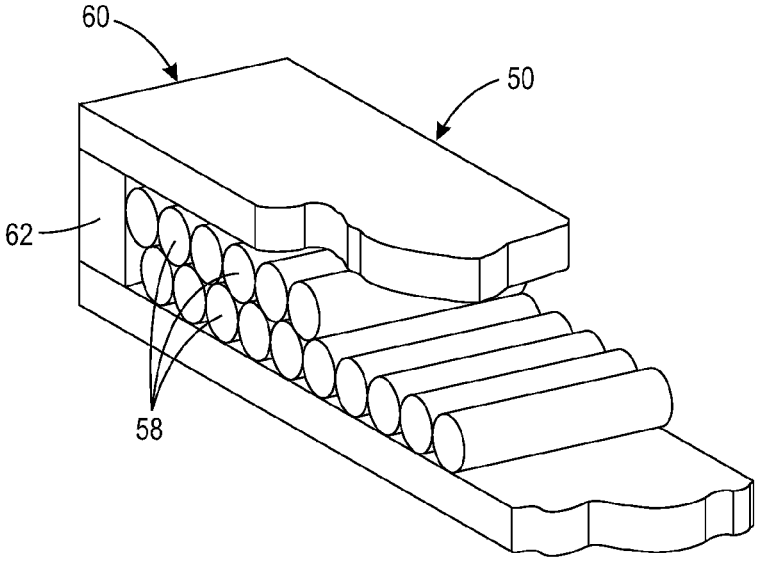
FIG. 2 is an partial perspective view of a known gradient index lens array having a portion of its housing removed.
Figure 3:
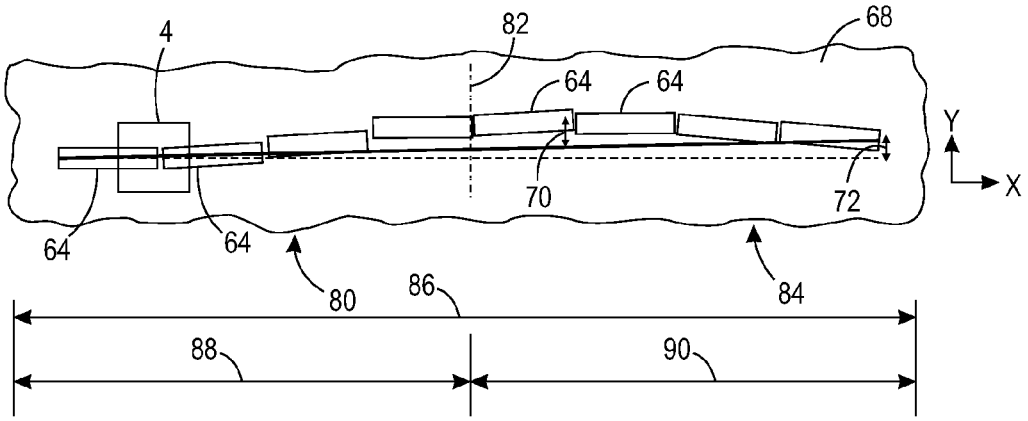
FIG. 3 is a top plan view of an embodiment of a light emitting diode print bar having a plurality of light emitting diode chips arranged thereon.
Figure 4:
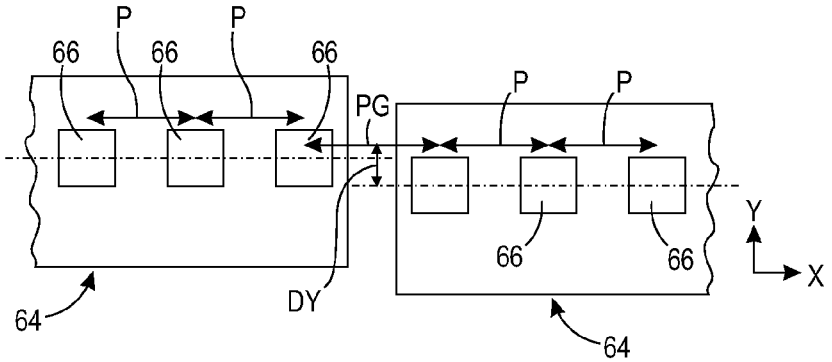
FIG. 4 is an enlarged top plan view of the enclosed region 4 shown in FIG. 3 depicting further details related to the light emitting diode print bar, e.g., individual light emitting diodes; and, FIG. 5 is a depiction of an embodiment of fiducial line pairs for use in the present method of dynamic control of thermal induced imaging errors.

At the outset, it should be appreciated that like drawing numbers on different drawing views identify identical, or functionally similar, structural elements of the embodiments set forth herein. Furthermore, it is understood that these embodiments are not limited to the particular methodology, materials and modifications described and as such may, of course, vary. It is also understood that the terminology used herein is for the purpose of describing particular aspects only, and is not intended to limit the scope of the disclosed embodiments, which are limited only by the appended claims.

Unless defined otherwise, all technical and scientific terms used herein have the same meaning as commonly understood to one of ordinary skill in the art to which these embodiments belong. As used herein, "fiducial" or "fiducial mark" is intended to be broadly construed as including any marking, e.g., cross hairs, bull's-eye, points, line, line pair, mark, portion of an impression, etc., used to designate a position on a printed image.

Furthermore, as used herein, the words "printer," "printer system", "printing system", "printer device" and "printing device" as used herein encompasses any apparatus, such as a digital copier, bookmaking machine, facsimile machine, multi-function machine, etc. which performs a print outputting function for any purpose, while "multi-function device" and "MFD" as used herein is intended to mean a device which includes a plurality of different imaging devices, including but not limited to, a printer, a copier, a fax machine and/or a scanner, and may further provide a connection to a local area network, a wide area network, an Ethernet based network or the internet, either via a wired connection or a wireless connection. An MFD can further refer to any hardware that combines several functions in one unit. For example, MFDs may include but are not limited to a standalone printer, one or more personal computers, a standalone scanner, a mobile phone, an MP3 player, audio electronics, video electronics, GPS systems, televisions, recording and/or reproducing media or any other type of consumer or non-consumer analog and/or digital electronics. Additionally, as used herein, "sheet," "sheet of paper" and "paper" refer to, for example, paper, transparencies, parchment, film, fabric, plastic, photo-finishing papers or other coated or non-coated substrate media in the form of a web upon which information or markings can be visualized and/or reproduced.

As used herein, "image bearing surface" is intended to mean any surface or material capable of receiving an image or a portion of an image, e.g., a photoreceptor drum, a photoreceptor belt, an intermediate transfer belt, an intermediate transfer drum, an imaging drum, or a document. Moreover, as used herein, "full width array" is intended to mean an array or plurality of arrays of photosensors having a length equal or greater than the width of the substrate to be coated, for example, similar to the full width array taught in U.S. Pat. No. 5,148,268. "Process direction", as used herein, is intended to mean the direction of media transport through a printer or copier, while "cross process direction" is intended to mean the perpendicular to the direction of media transport through a printer or copier.

"Absolute position correction" and "absolute correction", as used herein, are intended to mean the mathematical and/or electronic correction of a position of an LED to a specific location or position, while "relative position correction" and "relative correction" are intended to mean the mathematical and/or electronic correction of a position of an LED relative another LED within the same LPB. In other words, absolute correction permits the perceived positioning of an LED at a zero or start position, while relative correction permits the control of the perceived spacing between two LEDs.

As used herein, the term "average" shall be construed broadly to include any calculation in which a result datum or decision is obtained based on a plurality of input data, which can include but is not limited to, weighted averages, yes or no decisions based on rolling inputs, etc. Moreover, as used herein "real time" is intended to mean of or relating to a computer or computer system that updates or uses information at substantially the same rate as the information is received.

It should be understood that the use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

As used herein, "x-y-z" or "x-y" coordinate axes are used to refer to particular orthogonal directions as depicted in the various figures.

Moreover, although any methods, devices or materials similar or equivalent to those described herein can be used in the practice or testing of these embodiments, some embodiments of methods, devices, and materials are now described.

In some embodiments, the present dynamic control of and correction for thermal expansion induced imaging errors from LED print bars (LPBs) consists of three steps which can be implemented in a variety of ways. The steps are: a) determine the cross process direction position of each LED location, a subset of LEDs or at least the distance between two LEDs at or near the ends of the LPB; b) calculate a correction amount for magnification; and, c) make a correction to magnification.

A variety of methods may be used to determine the cross process direction position of each LED location, a subset of LEDs or the distance between two LEDs located proximate the ends of the LPB. It should be appreciated that the ends of the LPB are intended to be broadly construed to include all LEDs positioned on both sides of a mid-line or center of the LPB. Thus, end 80 is positioned on one side of centerline 82, while end 84 is positioned on the opposite side of centerline 82. In some embodiments, proximate the ends is intended to mean LEDs positioned farthest away from centerline 82, while in some embodiments, proximate the ends is intended to mean LEDs positioned anywhere within one of the respective sides or ends of the LPB. Moreover, LPB 68 comprises overall length 86, while ends 80 and 84 comprise lengths 88 and 90, respectively. The following examples are non-limiting and other methods may be used which fall within the scope of the claims.

In some embodiments, existing mark sensor chevrons that are normally used for image magnification and skew correction may be used to detect the cross process position of LEDs near or at each end of the LPB. Hence, the LPB is used to generate the chevrons on an image bearing surface, and after creation of the chevrons, sensors, such as a full width array, can be used to quantify the locations and thereby distance between the chevrons. The measured distance between chevrons can be directly correlated to the distance between the LEDs of interest. The foregoing type of measurement provides an average cross process magnification measurement. In other words, the absolute position of each LED is not known; however, the distance between the extents or limits of the LPB is known. The average spacing between LEDs across the entire LPB can then be calculated based on the number of LEDs located between the two quantified LEDs.

Figure 5:
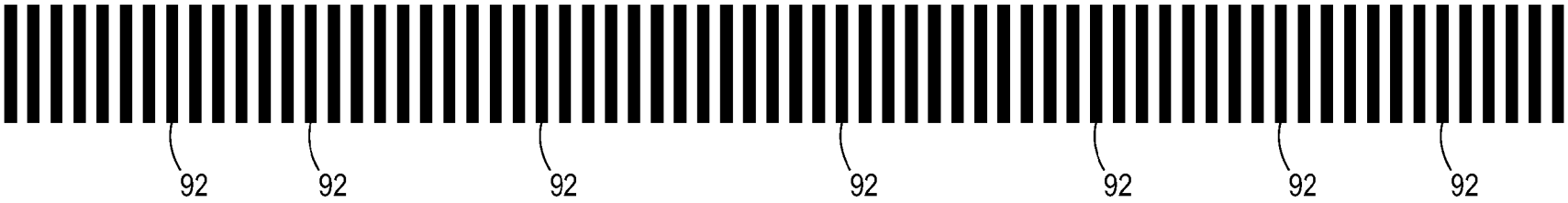

In some embodiments, the LPB is used to generate a pattern on an image bearing surface, wherein the pattern is formed using more than two LEDs along the full length of the LPB. For example, a suitable pattern may include a plurality of adjacent parallel fiducial lines such as the pattern of lines 92 depicted in FIG. 5. The position of all LEDs along the length of the LPB can be determined by measuring the positions of the fiducial lines, for example, using a full width image sensor. The quantification of the pattern provides data that can be used to determine the total magnification across the full length of the LPB as well as the local magnification within particular regions along the full length of the LPB, i.e., various distances between quantified LEDs. Some embodiments permit the quantification of each individual chip gap, i.e., an LED position is measured from each LED chip, thereby permitting accurate correction of non-uniform expansion across the length of the LPB.

The foregoing measurements may be made periodically during printing to provide magnification information feedback at a rate that is faster than the thermal time constant of the LPB. Alternatively, the foregoing measurements may be made as a one-time set-up of magnification, i.e., at the time of printer startup, and then calculate an adjusted magnification throughout printer use from temperature measurements obtained from one or more thermal sensors on the LPB and a known or experimentally determined coefficient of thermal expansion (CTE).

It should be appreciated that the foregoing measurements may also be obtained offline. In such embodiments, a printed pattern of markings or chevron may be made and subsequently quantified outside of the printer via means known in the art, for example, a conventional scanner. Offline measurements can be performed at startup and periodically throughout use of a printer. The measurements obtained offline must be communicated to the printing device either directly from the offline measuring unit or through entry by an operator. Calculations of corrections or magnification factors can then occur in accordance with methods described below.

The calculation of a correction amount for magnification may be performed using a number of methods. The following example embodiments are non-limiting and other methods may be used which fall within the scope of the claims.

In some embodiments, a ratio of desired magnification versus measured magnification is calculated and the ratio is subsequently used in the correction step described infra. In these embodiments, chevrons or other markings are formed on an image bearing surface by the LPB using LEDs in each end region of the LPB. Thus, two markings are formed, adjacent each end of the LPB. The "ideal" distance between the LEDs used to form the markings is known or predetermined, and the "ideal" distance is compared against the measured distance between the markings. As used herein, "'ideal' distance" is intended to mean a distance between two individual LEDs or a distance between two groups of LEDs which is known and considered to be the correct distance between the LEDs or groups of LEDs based on the geometry of the LPB at a particular temperature. In short, "'ideal' distance" is the distance between LEDs or groups of LEDs when thermal expansion of materials has not occurred, e.g., a distance at conventional room temperature, or a distance at 80 degrees Fahrenheit. Similar, as used herein, "'ideal' position" and "'ideal' location" are intended to mean the absolute location of an LED which is known and considered to be the correct position or location of that LED relative to an image bearing surface.

In some embodiments, a ratio of the cumulative error of desired magnification versus measured actual magnification at each point along the LPB is determined and is subsequently used in the correction step described infra. In these embodiments, chevrons or other markings are formed on an image bearing surface by the LPB using LEDs along the entire length of the LPB. Thus, a plurality of markings are formed along the length of the LPB. The "ideal" distance between each LED used to form the markings is known or predetermined, and the "ideal" distances are compared against the measured distances between the markings. In these embodiments, magnification errors may be corrected in specific regions or across the entire length of the LPB and such errors are absolute errors for each respective region and are not an average error determined by measuring the positions of two markings only.

In some embodiments, a ratio of new magnification versus setup magnification is determined and is subsequently used in the correction step described infra. In some of these embodiments, chevrons or other markings are formed on an image bearing surface by the LPB using LEDs along the entire length of the LPB or a subset thereof, e.g., markings formed at the ends of the LPB. At startup or setup of the machine, distances between two or more LEDs are determined, i.e., the setup magnification. Then during operation, new distances between the same two or more LEDs are determined using one of the methods described above, e.g., determining the distance between two LEDs in the end region of the LPB, determining the distance between a number of LEDs across the length of the LPB, determining the extent of material expansion based on the present temperature versus the startup or setup temperature, etc. In these embodiments, the object is to generally maintain the same printing characteristics throughout use rather than correcting for an absolute dimension. For example, the two positions are measured and a distance between the two positions is determined to be eight inches (8"), it is not relevant that the "ideal" distance should have been eight and one sixty-fourth inches (8 1/64"), but merely that the eight inch distance is maintained throughout operation. Alternatively, in some embodiments, the setup magnification may be established based on physical measurements of LED positions under controlled conditions, e.g., controlled temperature. In these embodiments, calculated in use magnification is compared to the setup magnification, and corrections for imaging errors are based on the change from the original LED position measurements.

Making a correction to the magnification based on the foregoing calculations may be performed using a number of methods. The following example embodiments are non-limiting and other methods may be used which fall within the scope of the claims.

In some embodiments, i.e., embodiments where continuous cross process magnification information is available, a cross process electronic correction may be applied. For example, one type of cross process electronic correction is the deletion or insertion/addition of lines in a dumb or smart way. A dumb way is necessary when an average magnification factor is determined, i.e., determining magnification based on the positions of LEDs located at the ends of the LPB only. Typically, this is accomplished by deleting or inserting/adding lines at equal periodic distances which are spaced according to the amount of magnification correction across the entire LPB. Additionally, the correction may be applied to the first chip gap where the cumulative error exceeds half of an LED pitch spacing. However, if continuous magnification information is available, i.e., LED positions are determined across the entire length of the LPB, the electronic correction may be applied as a function of where the cumulative errors call for one line deletion or insertion, e.g., at varying distances along the length of the LPB. This method also allows for a more accurate correction in the cross process chip gaps (dX) which vary from chip gap to chip gap, i.e., are not uniform across the full LPB. The foregoing cumulative method also permits correction for uneven heating and expansion of the LPB. In short, the cumulative correction across the full length of the LPB permits accurate correction for varying LED positions in the regions where changes have occurred rather than applying an average across the entire length of the LPB. It should be appreciated that the deletion or insertion/addition of lines described herein is performed using known techniques of digital image modification.

Moreover, it should be appreciated that line corrections may need to be dithered using known techniques if the smallest line time adjustment is larger than the amount needed to offset the cross process magnification adjustment. In short, dithering techniques may be needed for sub-line corrections, or in other words, corrections of less than a single line.

In some embodiments, changing the master clock frequency with a finely controlled phase-locked loop (PLL) clock, wherein the percent frequency change is inversely proportional to the percent magnification adjustment needed. The total line clock count is adjusted to keep the line time the same. The foregoing is accomplished by changing the number of variable line clocks, and thereby prevents the process magnification from being changed by the master clock frequency change. These embodiments can be used alone or in combination with the other correction techniques described above.

In some embodiments, the present systems and methods described above provide correction of cross process magnification errors due to thermal expansion in LPBs and in some embodiments provide correction of cross process chip gap errors in LPBs. In other words, correction may be applied based on the positions of adjacent LEDs on different chips. Thus, the position of each individual chip relative to other chips, adjacent or otherwise, may be corrected using the present systems and methods. Moreover, in some embodiments the present systems and methods provide in-situ continuous local magnification detection and correction with LPBs. In short, embodiments of the present systems and methods provide average cross process magnification control across the entire length of a LPB, while also providing local cross process magnification control for subsets of LEDs, within a single chip or across multiple chips, along the entire length of a LPB.

The foregoing present systems and methods permits the elimination of added heat sinks and cooling to maintain a given level of magnification/registration control. Moreover, corrections of chip gap errors and local magnification errors can be provided where needed for improved local registration. Additionally, in some embodiments, tuned master clock frequency control allows LPB magnification control without potential image artifacts of electronic correction of magnification in the cross-process direction. It should be appreciated that even without the use of a tuned master clock frequency control, image artifacts are minimized or removed by selective control of line insertion/deletion and, in some embodiments, through the use of dithering.

The present systems and methods correct distortions or defects in a light emitting diode print bar construction, e.g., misaligned LED emitters, (absolute position correction) as well as magnification errors induced by dynamic thermal expansion of the print bar itself (relative position correction). Moreover, errors may also be induced by the SELFOC lens as described above, e.g., local distortions of at least 15 μm. The errors may be induced in both the x and y directions, and usually occur over a distance of several LEDs consistent with the size or sizes of misaligned lenses. Traditional correction methods that applied to Raster Output Scanning (ROS) are not applicable and thus, the foregoing embodiments were developed. The present systems and methods provide several solutions to these problems that utilize fiducial line pairs, and can be run as often as needed. The present systems and methods address dynamic non-uniform changes in temperature, such as non-uniformity that could arise when one half of a LPB heats up from printing solid orange, while the other half prints nothing.

Although the foregoing embodiments are described with respect to use in association with LPBs, the same embodiments may also be used with laser imagers as such systems may also permit the insertion or deletion of lines within the cross process direction for the correction of magnification errors.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A method for dynamically compensating for thermal expansion and contraction of a light emitting diode print bar comprising first and second light emitting diodes having first and second ideal positions, respectively, the method comprising:

a) determining a first measured position of the first light emitting diode and a second measured position of the second light emitting diode;

b) comparing the first measured position and the second measured position to the first ideal position and the second ideal position, respectively; and, c) correcting a first difference between the first measured position and the first ideal position and a second difference between the second measured position and the second ideal position based on results from the step of comparing.

2. The method of claim 1 wherein the step of determining further comprises calculating a first measured distance between the first and second light emitting diodes based on the first and second measured positions and a first ideal distance based on the first and second ideal positions and the step of comparing further comprises comparing the first measured distance to the first ideal distance.

3. The method of claim 2 wherein the light emitting diode print bar comprises a length, the step of comparing comprises calculating an average magnification factor for the light emitting diode print bar based on a first ratio of the first ideal distance to the first measured distance and the step of correcting comprises applying the average magnification factor evenly along the length of the light emitting diode print bar.

4. The method of claim 3 wherein the step of correcting comprises inserting or deleting lines at equal periodic distances along the length of the light emitting diode print bar based on the average magnification factor.

5. The method of claim 1 wherein the step of determining further comprises forming a first marking and a second marking on an image bearing surface using the first light diode and the second light emitting diode, respectively, and the first and second measured positions are determined based on measuring the positions of the first and second markings, respectively.

6. The method of claim 1 wherein the light emitting diode print bar further comprises a first end and a second end opposite the first end, and the first light emitting diode is located proximate the first end and the second light emitting diode is located proximate the second end.

7. The method of claim 1 wherein the light emitting diode print bar comprises a length, the step of comparing comprises calculating an average magnification factor for the light emitting diode print bar and the step of correcting comprises applying the average magnification factor evenly along the length of the light emitting diode print bar.

8. The method of claim 7 wherein the step of correcting comprises inserting or deleting lines at equal periodic distances along the length of the light emitting diode print bar based on the average magnification factor.

9. The method of claim 1 wherein the first and second ideal positions are determined at an initial time of use of the light emitting diode print bar.

10. The method of claim 1 wherein the first and second ideal positions are determined at manufacture of the light emitting diode print bar.

11. The method of claim 1 wherein the light emitting diode print bar further comprises a third light emitting diode, the step of determining further comprises determining a third measured position of the third light emitting diode, the step of comparing further comprises comparing the third measured position to a third ideal position, and the step of correcting further comprises correcting a third difference between the third measured position and the third ideal position.

12. The method of claim 11 wherein the step of determining further comprises calculating a first measured distance between the first and second light emitting diodes based on the first and second measured positions, calculating a second measured distance between the second and third light emitting diodes based on the second and third measured positions, calculating a first ideal distance based on the first and second ideal positions, and calculating a second ideal distance based on the second and third ideal positions, and the step of comparing further comprises comparing the first measured distance to the first ideal distance and comparing the second measured distance to the second ideal distance.

13. The method of claim 12 wherein the step of comparing comprises calculating a first magnification factor for the first measured distance based on a first ratio of the first ideal distance to the first measured distance and a second magnification factor for the second measured distance based on a second ratio of the second ideal distance to the second measured distance, and the step of correcting comprises applying the first magnification factor to light emitting diodes positioned between the first and second light emitting diodes and applying the second magnification factor to light emitting diodes positioned between the second and third light emitting diodes.

14. The method of claim 13 wherein the step of correcting comprises inserting or deleting lines at equal periodic distances between the first and second light emitting diodes based on the first magnification factor and inserting or deleting lines at equal periodic distances between the second and third light emitting diodes based on the second magnification factor.

15. The method of claim 11 wherein the step of determining further comprises forming a first marking, a second marking and a third marking on an image bearing surface using the first light diode, the second light emitting diode and the third light emitting diode, respectively, and the first, second and third measured positions are determined based on measuring the positions of the first, second and third markings, respectively.

16. The method of claim 11 wherein the step of comparing comprises calculating a first magnification factor for the first measured distance and a second magnification factor for the second measured distance, and the step of correcting comprises applying the first magnification factor to light emitting diodes positioned between the first and second light emitting diodes and applying the second magnification factor to light emitting diodes positioned between the second and third light emitting diodes.

17. The method of claim 16 wherein the step of correcting comprises inserting or deleting lines at equal periodic distances between the first and second light emitting diodes based on the first magnification factor and inserting or deleting lines at equal periodic distances between the second and third light emitting diodes based on the second magnification factor.

18. The method of claim 11 wherein the first, second and third ideal positions are determined at an initial time of use of the light emitting diode print bar.

19. The method of claim 11 wherein the first, second and third ideal positions are determined at manufacture of the light emitting diode print bar.

20. The method of claim 1 wherein the light emitting diode print bar comprises a length and the step of correcting comprises at least one of the following: inserting or deleting lines along the length of the light emitting diode print bar; and, dithering along the length of the light emitting diode print bar.

21. A method for dynamically compensating for thermal expansion and contraction of a light emitting diode print bar comprising first and second light emitting diodes having first and second ideal positions, respectively, the method comprising:

a) determining a first measured distance between the first light emitting diode and the second light emitting diode and a first ideal distance between the first ideal position and the second ideal position;

b) comparing the first measured distance to the first ideal distance; and, c) correcting the first measured distance to be equal to the first ideal distance based on results from the step of comparing.

* * * * *